US006903691B2

(12) United States Patent
Sato et al.

(10) Patent No.: US 6,903,691 B2
(45) Date of Patent: Jun. 7, 2005

(54) SURFACE-MOUNT TYPE ANTENNA AND ANTENNA APPARATUS

(75) Inventors: Akinori Sato, Kyoto (JP); Takanori Ikuta, Kyoto (JP); Kazuo Watada, Kyoto (JP); Shunichi Murakawa, Kyoto (JP)

(73) Assignee: Kyocera Corporation, Kyoto (JP)

( * ) Notice: Subject to any disclaimer, the term of this patent is extended or adjusted under 35 U.S.C. 154(b) by 1 day.

(21) Appl. No.: 10/724,579

(22) Filed: Nov. 26, 2003

(65) Prior Publication Data

US 2004/0169606 A1 Sep. 2, 2004

(30) Foreign Application Priority Data

Nov. 28, 2002 (JP) ..... P2002-346356

(51) Int. Cl.[7] ..... H01Q 1/24; H01Q 1/36
(52) U.S. Cl. ..... 343/700 MS; 343/702
(58) Field of Search ..... 343/700 MS, 702, 343/846, 895

(56) References Cited

U.S. PATENT DOCUMENTS 5,748,149 A 5/1998 Kawahata ..... 343/700 MS
5,861,854 A * 1/1999 Kawahata et al. ..... 343/702
5,867,126 A * 2/1999 Kawahata et al. ..... 343/702
6,614,398 B2 * 9/2003 Kushihi et al. ..... 343/700 MS
6,680,700 B2 * 1/2004 Hilgers ..... 343/700 MS
6,734,825 B1 * 5/2004 Guo et al. ..... 343/700 MS
6,803,881 B2 * 10/2004 Ishihara et al. ..... 343/700 MS
6,806,832 B2 * 10/2004 Sato et al. ..... 343/700 MS
2004/0085245 A1 * 5/2004 Miyata et al. ..... 343/700 MS
2004/0125032 A1 * 7/2004 Ikuta et al. ..... 343/702

FOREIGN PATENT DOCUMENTS

JP 9-162633 6/1997

* cited by examiner

*Primary Examiner*—Tan Ho
(74) *Attorney, Agent, or Firm*—Hogan & Hartson LLP

(57) ABSTRACT

The surface-mount type antenna includes: a substantially rectangular parallelepiped base body; feeding and ground terminals formed on one side surface of the base body; and a radiating electrode, to one end of which is connected the ground terminal, disposed such that its other end extends from one side surface, through another end side part of one principal surface of the base body, to the one end side part thereof, then turns to the other end side part; and is eventually formed into an open end located near the other end side part. The feeding terminal is disposed near the radiating electrode. The antenna apparatus is constructed by mounting the surface-mount type antenna on the mounting substrate having the feeding electrode, the ground electrode, and the ground conductor layer.

24 Claims, 8 Drawing Sheets

SURFACE-MOUNT TYPE ANTENNA AND ANTENNA APPARATUS

BACKGROUND OF THE INVENTION

1. Field of the Invention

The present invention relates to a compact surface-mount type antenna and an antenna apparatus for use in mobile communication equipment such as a cellular phone.

2. Description of the Related Art

Recently, in keeping with rapid advancement of downsized, lightweight, and high-performance mobile communication equipment such as a cellular phone, miniaturization and high performance have come to be increasingly demanded of an antenna which constitutes such equipment. To meet such demands, for example, a surface-mount type antenna has hitherto been developed.

Now, a surface-mount type antenna of conventional design and an antenna apparatus incorporating the antenna will be described with reference to a perspective view shown in FIG. 7.

In FIG. 7, reference numeral 90 represents a surface-mount type antenna. The surface-mount type antenna 90 is mounted on a mounting substrate 96, thus constituting an antenna apparatus 101. In the surface-mount type antenna 90 shown in FIG. 7, reference numeral 91 represents a substantially rectangular parallelepiped base body; 92 represents a feeding terminal; 93 represents a ground terminal; and 94 represents a radiating electrode. Moreover, in the mounting substrate 96, reference numeral 97 represents a substrate; 98 represents a feeding electrode; 99 represents a ground electrode; and 100 represents a ground conductor layer.

In the conventional surface-mount type antenna 90, the feeding terminal 92 and the ground terminal 93 are formed on the side surface of the base body 91. The radiating electrodes 94, which is routed as a long conductor pattern, is formed so that their ends extend upwardly from the ground terminal 93 on the side surface, is then substantially U-shaped as viewed plane-wise, on the top surface of the base body 91 to form nearly a loop, and extend downwardly from the side surface downwardly toward the feeding terminal 92. The capacity of the radiating electrode 94 is controlled by providing a part of a vicinity of the feeding terminal 92 of the radiating electrode 94 with a gap 95, in order to match the impedance with the feeding electrode 98 (feeding line) of the mounting substrate 96.

Meanwhile, in the mounting substrate 96, on the top surface of the substrate 97 are arranged the feeding electrode 98, the ground electrode 99, and the ground conductor layer 100. The ground conductor layer 100 is arranged face to face with one side of the ground electrode 99 and has connection with the ground electrode 99.

Then, the surface-mount type antenna 90 is mounted on the top surface of the mounting substrate 96, with the feeding terminal 92 connected to the feeding electrode 98, and the ground terminal 93 connected to the ground electrode 99. Thereupon, the antenna apparatus 101 is realized.

The related art is disclosed in Japanese Unexamined Patent Publication JP-A 9-162633 (1997).

However, the conventional surface-mount type antenna. 90 poses the following problems. By adjusting the size of the gap 95 which is formed in the radiating electrode 94 to achieve impedance matching between the radiating electrode 94 and the feeding electrode 98, the impedance of the radiating electrode 94 can be changed. Simultaneously, however, the resonant frequency of the antenna varies with the change of the impedance. This makes it difficult to attain the desired antenna characteristics as designed.

SUMMARY OF THE INVENTION

The invention has been devised in view of the above-described problems with the conventional art, and accordingly its object is to provide a surface-mount type antenna and an antenna apparatus that succeed in readily attaining satisfactory antenna characteristics with stability, in enhancing radiation efficiency, and in achieving miniaturization.

The invention provides a surface-mount type antenna comprising:

a base body made of a substantially rectangular parallelepiped dielectric or magnetic material;

a feeding terminal formed at one end side part of one side surface of the base body;

a ground terminal formed at another end side part of one side surface of the base body; and a radiating electrode, to one end of which is connected the ground terminal, disposed such that its other end extends from the other end side part of one side surface, through the other end side part of one principal surface of the base body, to the one end side part of one principal surface, then turns to one side surface so as to extend farther toward the other end side part of one principal surface, and is eventually formed into an open end facing substantially perpendicularly with a midpoint of the other end side part of one principal surface, wherein the feeding terminal is so disposed as to extend from the one end side part of one side surface to the one end side part of one principal surface, and has its open end arranged in proximity to the radiating electrode.

According to the invention, the radiating electrode extends to the one end side part of one principal surface, and then turns to the other end side part, and is eventually formed into an open end facing substantially perpendicularly with a midpoint of the other end side part of one principal surface. Moreover, the feeding terminal is disposed with its open end located in proximity to the radiating electrode. With this configuration, the radiating electrode can be electromagnetically coupled to the feeding terminal through an electric capacitance generated therebetween. Further, at the time of mounting the antenna on the mounting substrate, since a capacitance can be created between that part of the radiating electrode which extends from the turned portion (bent portion) to the open end and the ground conductor layer of the mounting substrate, the resonant frequency of the radiating electrode can be decreased. This makes it possible to achieve miniaturization of the antenna without increasing the dielectric constant of the base body, and without excessively slenderizing the radiating electrode.

According to the invention, the impedance matching between the radiating electrode and the feeding electrode (feeding line) of the mounting substrate on which the radiating electrode is mounted can be achieved by adjusting the capacitance between the radiating electrode and the feeding terminal. Meanwhile, a predominant factor in the magnitude of the resonant frequency of the antenna is the capacitance between that part of the radiating electrode which extends from the turned portion to the open end and the ground conductor layer of the mounting substrate. Hence, variation in the resonant frequency of the antenna, which results from the impedance adjustment achieved by adjusting the capacitance between the radiating electrode and the feeding terminal, can be minimized, whereby making it possible to obtain a compact surface-mount type antenna which offers higher radiation efficiency and stable antenna characteristics.

The invention provides a surface-mount type antenna comprising:

a base body made of a substantially rectangular parallelepiped dielectric or magnetic material;

a feeding terminal formed at one end side part of one side surface of the base body;

a ground terminal formed at another end side part of one side surface of the base body; and a radiating electrode, to one end of which is connected the ground terminal, disposed such that its other end extends from the other end side part of one side surface, through the other end side parts of one principal surface and another side surface of the base body, to the one end side part of the other side surface, then turns to one end side part of one principal surface so as to extend farther toward the other end side part of one principal surface, and is eventually formed into an open end facing substantially perpendicularly with a midpoint of the other end side part of one principal surface, wherein the feeding terminal is so disposed as to extend from the one end side part of one side surface to the one end side part of one principal surface, and has its open end arranged in proximity to the radiating electrode.

According to the invention, the radiating electrode extends to the one end side part of one side surface, and then turns to the other end side part, and is eventually formed into an open end facing substantially perpendicularly with a midpoint of the other end side part of one principal surface. Moreover, the feeding terminal is disposed with its open end located in proximity to the radiating electrode. With this configuration, the radiating electrode can be electromagnetically coupled to the feeding terminal through an electric capacitance generated therebetween. Further, at the time of mounting the antenna on the mounting substrate, since a capacitance can be created between that part of the radiating electrode which extends from the turned portion (bent portion) to the open end and the ground conductor layer of the mounting substrate, the resonant frequency of the radiating electrode can be decreased. This makes it possible to achieve miniaturization of the antenna without increasing the dielectric constant of the base body, and without excessively slenderizing the radiating electrode.

According to the invention, the impedance matching between the radiating electrode and the feeding electrode (feeding line) of the mounting substrate on which the radiating electrode is mounted can be achieved by adjusting the capacitance between the radiating electrode and the feeding terminal. Meanwhile, a predominant factor in the magnitude of the resonant frequency of the antenna is the capacitance between that part of the radiating electrode which extends from the turned portion to the open end and the ground conductor layer of the mounting substrate. Hence, variation in the resonant frequency of the antenna, which results from the impedance adjustment achieved by adjusting the capacitance between the radiating electrode and the feeding terminal, can be minimized, whereby making it possible to obtain a compact surface-mount type antenna which offers higher radiation efficiency and stable antenna characteristics.

In addition, according to the invention, the radiating electrode extends from the other end of one side surface, through another end side parts of one principal surface and another side surface of the base body, to the one end side part of the other side surface, then turns to one end side part of one principal surface so as to extend farther toward the other end side part of one principal surface. Therefore, the radiating electrode can be made longer, and a compact surface-mount type antenna can be obtained.

The invention provides a surface-mount type antenna comprising:

a base body made of a substantially rectangular parallelepiped dielectric or magnetic material;

a feeding terminal formed at one end side part of one side surface of the base body;

a ground terminal formed at another end side part of one side surface of the base body; and a radiating electrode, to one end of which is connected the ground terminal, disposed such that its other end extends from the other end side part of one side surface, through the other end side part of one principal surface of the base body, to the one end side part of one principal surface, then extends to the one end side part of one side surface so as to extend farther toward the other end side part of one side surface, and is eventually formed into an open end facing substantially perpendicularly with a midpoint of the other end side part of one side surface, wherein the feeding terminal has its open end arranged in proximity to the radiating electrode in the one end side part of one side surface.

According to the invention, the radiating electrode extends the one end side part of one side surface, and then turns to the other end side, and is eventually formed into an open end facing substantially perpendicularly with a midpoint of the other end side part of one side surface. Moreover, the feeding terminal is disposed with its open end located in proximity to the radiating electrode. With this configuration, the radiating electrode can be electromagnetically coupled to the feeding terminal through an electric capacitance generated therebetween. Further, at the time of mounting the antenna on the mounting substrate, since a capacitance can be created between that part of the radiating electrode which extends from the turned portion (bent portion) to the open end and the ground conductor layer of the mounting substrate, the resonant frequency of the radiating electrode can be decreased. This makes it possible to achieve miniaturization of the antenna without increasing the dielectric constant of the base body, and without excessively slenderizing the radiating electrode.

According to the invention, the impedance matching between the radiating electrode and the feeding electrode (feeding line) of the mounting substrate on which the radiating electrode is mounted can be achieved by adjusting the capacitance between the radiating electrode and the feeding terminal. Meanwhile, a predominant factor in the magnitude of the resonant frequency of the antenna is the capacitance between that part of the radiating electrode which extends from the turned portion to the open end and the ground conductor layer of the mounting substrate. Hence, variation in the resonant frequency of the antenna, which results from the impedance adjustment achieved by adjusting the capacitance between the radiating electrode and the feeding terminal, can be minimized, whereby making it possible to obtain a compact surface-mount type antenna which offers higher radiation efficiency and stable antenna characteristics.

In addition, according to the invention, the radiating electrode extends from the other end side part of one side surface, through the other end side part of one principal surface of the base body, to the one end side part of one principal surface, then extends to the one end side part of one side surface so as to extend farther toward the other end side part of one side surface. Therefore, a distance between the ground conductor layer and the conductor portion from the turned portion to the open end becomes short and a larger capacitance component is obtained, with the result that a compact surface-mount type antenna can be obtained.

The invention provides a surface-mount type antenna comprising:

a base body made of a substantially rectangular parallelepiped dielectric or magnetic material;

a feeding terminal formed at one end side part of one side surface of the base body;

a ground terminal formed at another end side part of one side surface of the base body; and a radiating electrode, to one end of which is connected the ground terminal, disposed such that its other end extends from the other end side part of one side surface, through the other end side parts of one principal surface and another side surface of the base body, to the one end side part of the other side surface, then extends through the one end side part of one principal surface to the one end side part of one side surface so as to extend farther toward the other end side part of one side surface, and is eventually formed into an open end facing substantially perpendicularly with a midpoint of the other end side part of one side surface, wherein the feeding terminal has its open end arranged in proximity to the radiating electrode in the one end side part of one side surface.

According to the invention, the radiating electrode extends to the one end side part of one side surface, and then turns to the other end side part, and is eventually formed into an open end facing substantially perpendicularly with a midpoint of the other end side part of one side surface. Moreover, the feeding terminal is disposed with its open end located in proximity to the radiating electrode. With this configuration, the radiating electrode can be electromagnetically coupled to the feeding terminal through an electric capacitance generated therebetween. Further, at the time of mounting the antenna on the mounting substrate, since a capacitance can be created between that part of the radiating electrode which extends from the turned portion (bent portion) to the open end and the ground conductor layer of the mounting substrate, the resonant frequency of the radiating electrode can be decreased. This makes it possible to achieve miniaturization of the antenna without increasing the dielectric constant of the base body, and without excessively slenderizing the radiating electrode.

According to the invention, the impedance matching between the radiating electrode and the feedinglelectrode (feeding line) of the mounting substrate on which the radiating electrode is mounted can be achieved by adjusting the capacitance between the radiating electrode and the feeding terminal. Meanwhile, a predominant factor in the magnitude of the resonant frequency of the antenna is the capacitance between that part of the radiating electrode which extends from the turned portion to the open end and the ground conductor layer of the mounting substrate. Hence, variation in the resonant frequency of the antenna, which results from the impedance adjustment achieved by adjusting the capacitance between the radiating electrode and the feeding terminal, can be minimized, whereby making it possible to obtain a compact surface-mount type antenna which offers higher radiation efficiency and stable antenna characteristics.

In addition, according to the invention, the radiating electrode extends from the other end side part of one side surface, through the other end side parts of one principal surface and another side surface of the base body, to the one end side part of the other side surface, then extends through the one end side part of one side surface to the one end side part of one side surface so as to extend farther toward the other end side part of one side surface. Therefore, a distance between the ground conductor layer and the conductor portion from the turned portion to the open end becomes short, with the result that a larger capacitance can be obtained. Further, the radiating electrode can be made longer, therefore a compact surface-mount type antenna can be obtained.

In the invention, it is preferable that the length of the radiating electrode between the open end and a turned portion on the one end side part of one principal surface or one side surface is kept in a range of ⅕ to ¾ of the length of one principal surface or one side surface of the base body.

According to the invention, when the length of the radiating electrode between the open end and the turned portion on the one end side part of one principal surface or one side surface is kept in a range of ⅕ to ¾ of the length of one principal surface or one side surface of the base body, an antenna which facilitates frequency adjustment can be obtained.

In the invention, it is preferable that the base body has a through hole which penetrates all the way through from one end face to the other end face thereof, or a groove formed on another principal surface thereof so as to penetrate all the way through from one end face to the other end face.

According to the invention, when the base body has a through hole which penetrates all the way through from one end face to the other end face thereof, or a groove formed on the other principal surface thereof so as to penetrate all the way through from one end face to the other end face, the bandwidth of antenna can be increased.

In the invention, it is preferable that the base body is made of a dielectric material having a relative dielectric constant $\in r$ which is kept within a range from 3 to 30.

According to the invention, an effective length of the radiating electrode is decreased, and thus the current distribution region is increased in area. This allows the radiating electrode to emit a larger quantity of radio waves, resulting in advantages in enhancing a gain of the antenna and in achieving miniaturization of the surface-mount type antenna.

In the invention, it is preferable that the base body is made of a magnetic material having a relative magnetic permeability $\mu r$ which is kept within a range from 1 to 8.

According to the invention, the radiating electrode has a higher impedance, which results in a low Q factor in the antenna, and the bandwidth is accordingly increased.

The invention further provides an antenna apparatus comprising:

a mounting substrate having formed thereon a feeding electrode, a ground electrode, and a ground conductor layer which is arranged face to face with one side of the ground electrode and has connection with the ground electrode; and the surface-mount type antenna mentioned above, wherein the antenna apparatus is constructed by mounting the surface-mount type antenna on the mounting substrate, with another principal surface of the base body arranged on the top surface of the mounting substrate face to face with the other side of the ground electrode, and simultaneously connecting the feeding terminal and the ground terminal to the feeding electrode and the ground electrode, respectively.

According to the invention, the antenna apparatus is constructed as follows. The surface-mount type antenna of the invention is mounted on the mounting substrate having formed thereon the feeding electrode, the ground electrode, and the ground conductor layer which is arranged face to face with one side of the ground electrode and has connection with the ground electrode. Simultaneously, the feeding terminal and the ground terminal are connected to the feeding electrode and the ground electrode, respectively. Hence, by adjusting the capacitance created between the radiating electrode of the surface-mount type antenna having the turned portion and the feeding electrode, ground electrode, and ground conductor layer of the mounting substrate, impedance matching can be readily achieved between the radiating electrode and the feeding electrode. Moreover, proper setting and adjustment of the resonant frequency and radiation efficiency of the radiating electrode, as well as miniaturization, can also be achieved with ease, whereby making it possible to obtain a compact antenna apparatus which offers higher radiation efficiency and stable antenna characteristics.

As described heretofore, according to the invention, it is possible to provide a surface-mount type antenna and an antenna apparatus capable of attaining satisfactory antenna characteristics with stability, of enhancing radiating efficiency, and of achieving miniaturization.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
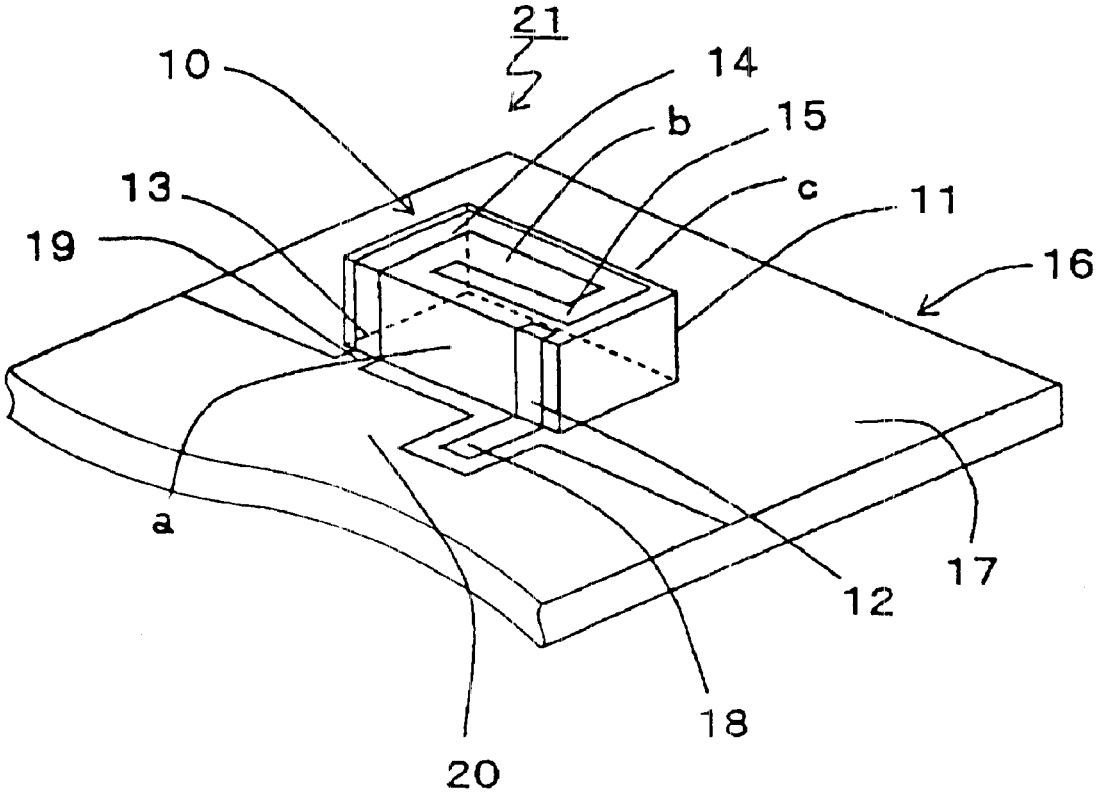
FIG. 1A is a perspective view showing a surface-mount type antenna according to a first embodiment of the invention, and also an antenna apparatus that is constituted by mounting the surface-mount type antenna on a top surface of a mounting substrate according to a first embodiment of the invention.

Now referring to the drawings, preferred embodiments of the invention are described below.

Hereafter, with reference to the accompanying drawings, a description will be given as to a surface-mount type antenna and an antenna apparatus according to an embodiment of the invention.

Figure 1B:
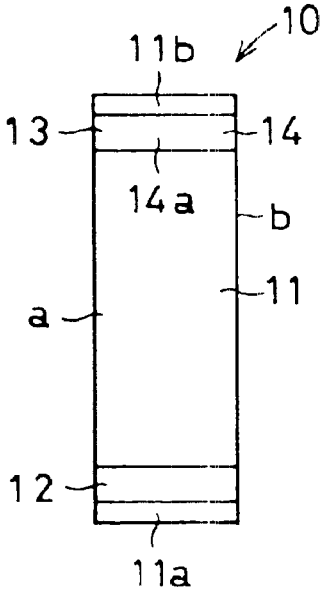
FIG. 1B is a view showing the surface-mount type antenna according to the first embodiment of the invention, viewed from one side surface side.
Figure 1C:
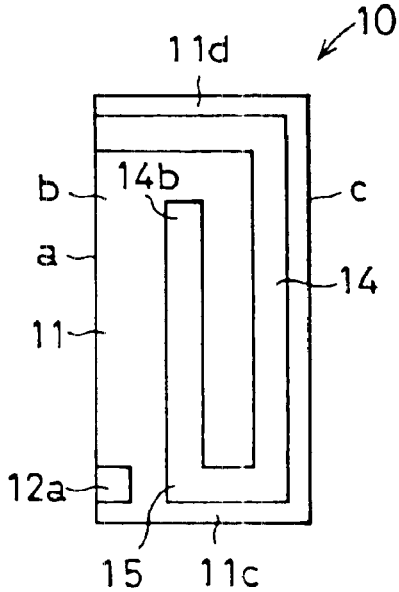
FIG. 1C is a view showing the surface-mount type antenna according to the first embodiment of the invention, viewed from one principal surface side.
Figure 1D:
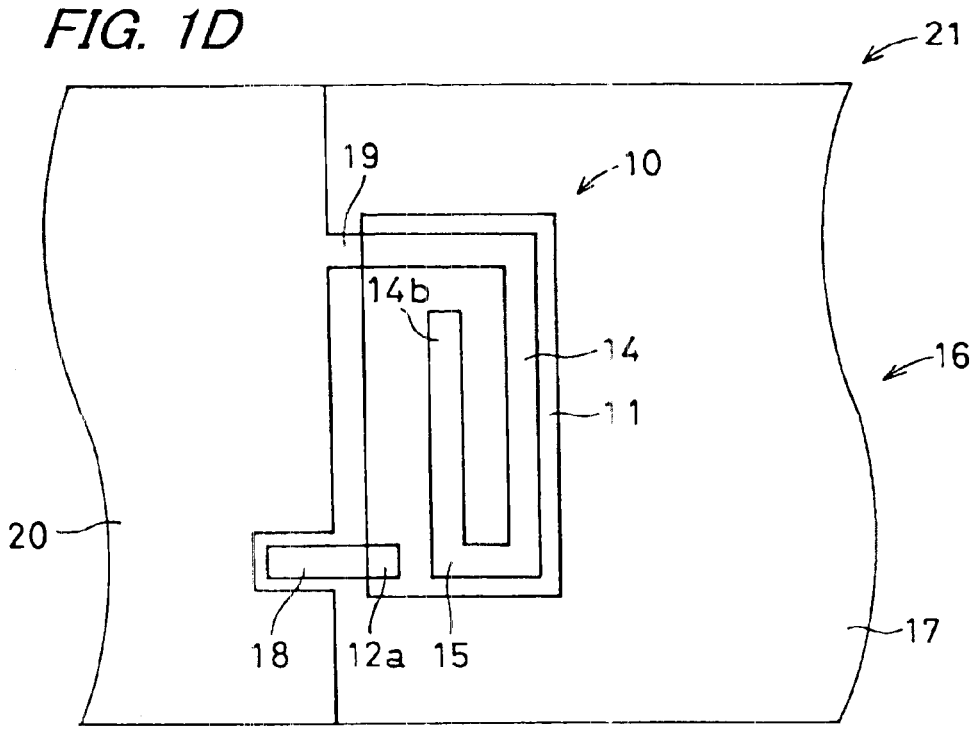
FIG. 1D is a plan view showing the surface-mount type antenna according to the first embodiment of the invention, and also the antenna apparatus that is constituted by mounting the surface-mount type antenna on a top surface of the mounting substrate according to the first embodiment of the invention.

FIG. 1A is a perspective view showing a surface-mount type antenna according to a first embodiment of the invention, and also an antenna apparatus that is constituted by mounting the surface-mount type antenna on a top surface of a mounting substrate according to a first embodiment of the invention;

FIG. 1B is a view showing the surface-mount type antenna according to the first embodiment of ttle invention, viewed from one side surface side; FIG. 1C is a view showing the surface-mount type antenna according to the first embodiment of the invention, viewed from one principal surface side; and FIG. 1D is a plan view showing the surface-mount type antenna according to the first embodiment of the invention, and also the antenna apparatus that is constituted by mounting the surface-mount type antenna on a top surface of the mounting substrate according to the first embodiment of the invention.

In FIGS. 1A to 1D, a surface-mount type antenna 10 embodying the invention comprises a base body 11, a feeding terminal 12, a ground terminal 13 and a radiating electrode 14. The base body 11 is made of a substantially rectangular parallelepiped dielectric or magnetic material. The feeding terminal 12 is formed at one end side part 11*a* of one side surface a of the base body 11. The ground terminal 13 is formed at another end side part 11*b* of one side surface a of the base body 11. The radiating electrode 14 is formed of a line-shaped conductor. The radiating electrode 14, to one end 14*a* of which is connected the ground terminal 13, is disposed such that its other end 14*b* extends from the other end part 11*b* of one side surface a of the base body 11, through the other end side part 11*d* of one principal surface b of the base body 11, to the one end side part 11*c* of one principal surface b, then turns to one side surface a so as to extend farther toward the other end side part 11*d* of one principal surface b, and is eventually formed into an open end facing substantially perpendicularly with a midpoint of the other end side part 11*d* of one principal surface b. In addition, in the radiating electrode 14, a turned portion 15 is formed on the one end side part 11*c* of one principal surface b. The feeding terminal 12 is so disposed as to extend from the one end side part 11*a* of one side surface a to the one end side part 11*c* of one principal surface b, and has its open end 12*a* arranged in proximity to the radiating electrode 14.

Moreover, a mounting substrate 16 comprises a substrate 17, a feeding electrode 18 formed on the top surface of the substrate 17, a ground electrode 19, and a ground conductor layer 20 having connection with the ground electrode 19. The ground conductor layer 20 is arranged face to face with one side of the ground electrode 19, that is, in the example shown in FIGS. 1A to 1D, arranged on the left-hand front side of the top surface of the substrate.

Then, the surface-mount type antenna 10 according to the first embodiment of the invention is mounted on the mounting substrate 16, with another principal surface (corresponding to the bottom surface, in the embodiment shown in FIG. 1A) of the base body 11 arranged on the top surface of the mounting substrate 16 face to face with the other side of the ground electrode 19 (arranged on the right-hand rear side of the top surface of the substrate, in the embodiment shown in FIG. 1A). Simultaneously, the feeding terminal 12 and the ground terminal 13 are connected to the feeding electrode 18 and the ground electrode 19, respectively. Thereupon, an antenna apparatus 21 of the invention is realized.

A remarkable feature of the surface-mount type antenna 10 according to the first embodiment of the invention is the configurations of the radiating electrode 14 and the feeding terminal 12. Specifically, the radiating electrode 14 is formed that its other end extends from the one end side part 11*c* of one principal surface b of the base body 11 to the other end side part 11*d* thereof, thereby creating the turned portion 15, and is eventually formed into an open end 14*b* near the other end side part 11*d*. The length of the radiating electrode 14 between the turned portion 15 and the open end 14*b* is kept in a range of ⅕ to ¾ of the length of the base body 11. Meanwhile, the feeding terminal 12 has its open end 12*a* opposed to the radiating electrode 14 near the turned portion 15.

Since the turned portion 15 of the radiating electrode 14 faces with the feeding terminal 12 through the base body 11, the radiating electrode 14 is electromagnetically coupled to the feeding terminal 12 through an electric capacitance generated therebetween.

Then, the surface-mount type antenna 10 according to the first embodiment of the invention thus constructed is mounted on the top surface of the mounting substrate 16 at a distance of approximately 0.5 mm to 3 mm, for example, from the end of the ground conductor layer 20. Simultaneously, the ground terminal 13 is connected via the ground electrode 19 to the ground conductor layer 20. Thereupon, the antenna apparatus 21 of the invention is operable at a frequency band of approximately 1 GHz to 10 GHz, for example.

Note that the radiating electrode 14 acts as a (¼) λ resonator. The longer the radiating electrode 14 in length, the lower the operating frequency. Moreover, the larger the capacitance component between the ground conductor layer 20 and that conductor part of the radiating electrode 14 which extends from the open end 14*b* to the turned portion 15, the lower the operating frequency. As is practiced in the surface-mount type antenna 21 of the invention, by configuring the radiating electrode 14 in such a way as to make turns over the surfaces of the base body 11, the base body 11 can be kept small in outer dimension, thus achieving compactness in the antenna.

Figure 2A:
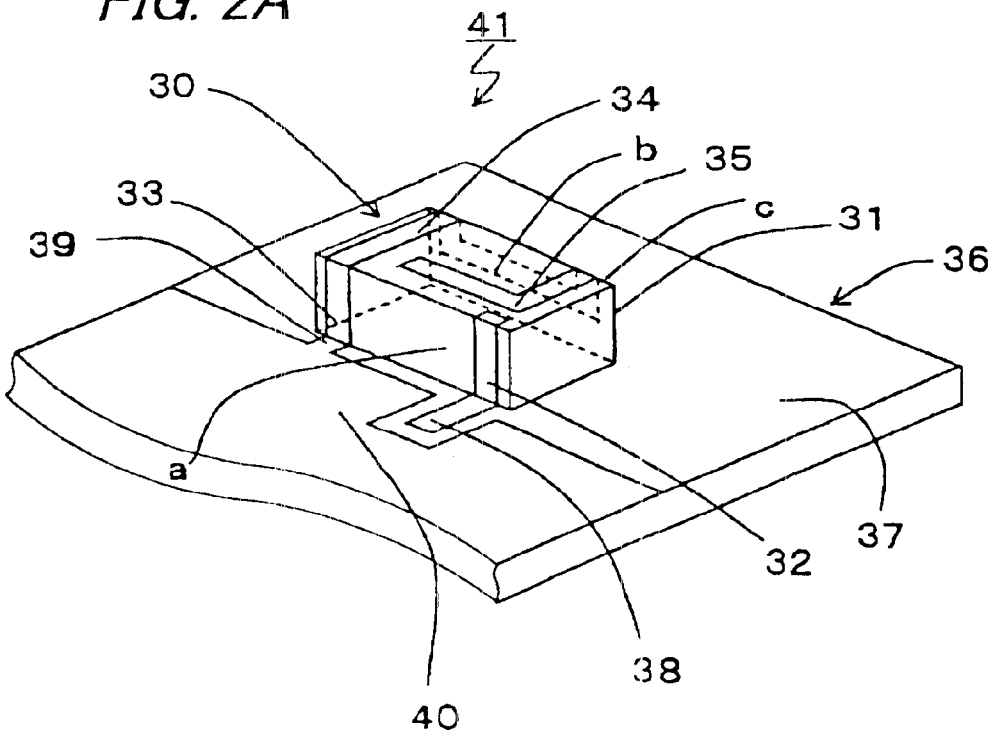
FIG. 2A is a perspective view showing a surface-mount type antenna according to a second embodiment of the invention, and also an antenna apparatus that is constituted by mounting the surface-mount type antenna on the top surface of a mounting substrate according to a second embodiment of the invention.
Figure 2B:
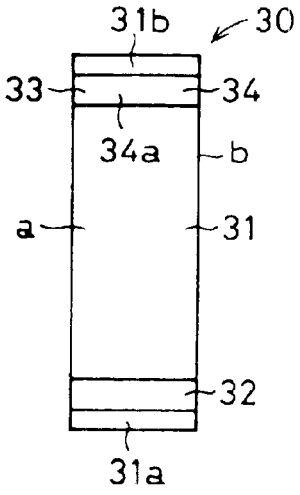
FIG. 2B is a view showing the surface-mount type antenna according to the second embodiment of the invention, viewed from one side surface side.
Figure 2C:
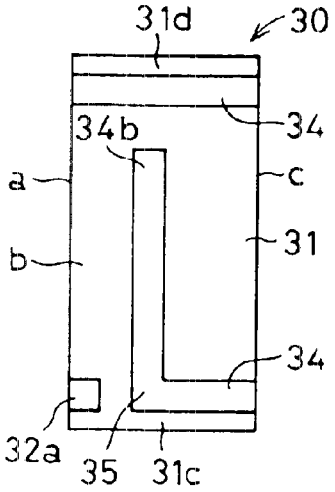
FIG. 2C is a view showing the surface-mount type antenna according to the second embodiment of the invention, viewed from one principal surface side.
Figure 2D:
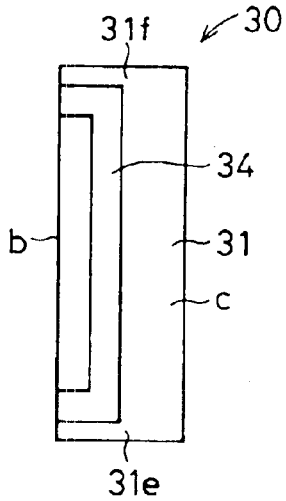
FIG. 2D is a view showing the surface-mount type antenna according to the second embodiment of the invention, viewed from another side surface side.
Figure 2E:
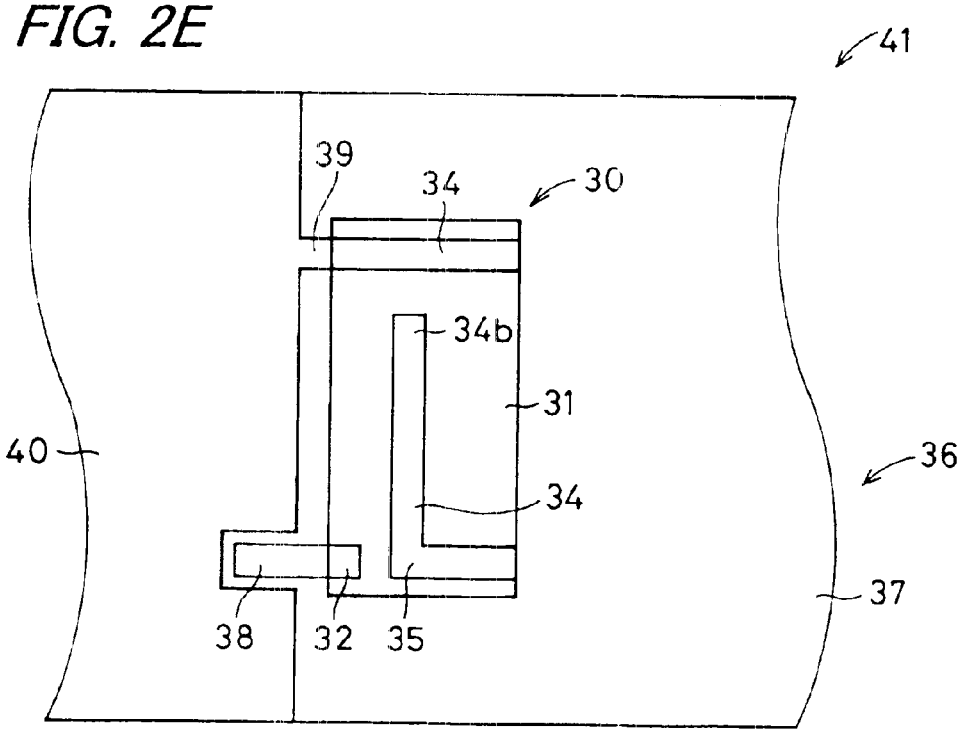
FIG. 2E is a plan view showing the surface-mount type antenna according to the second embodiment of the invention, and also the antenna apparatus that is constituted by mounting the surface-mount type antenna on the top surface of the mounting substrate according to the second embodiment of the invention.

FIG. 2A is a perspective view showing a surface-mount type antenna according to a second embodiment of the invention, and also an antenna apparatus that is constituted by mounting the surface-mount type antenna on the top surface of a mounting substrate according to a second embodiment of the invention; FIG. 2B is a view showing the surface-mount type antenna according to the second embodiment of the invention, viewed from one side surface side; FIG. 2C is a view showing the surface-mount type antenna according to the second embodiment of the invention, viewed from one principal surface side; FIG. 2D is a view showing the surface-mount type antenna according to the second embodiment of the invention, viewed from another side surface side; and FIG. 2E is a plan view showing the surface-mount type antenna according to the second embodiment of the invention, and also the antenna apparatus that is constituted by mounting the surface-mount type antenna on the top surface of the mounting substrate according to the second embodiment of the invention.

In FIGS. 2A to 2E, a surface-mount type antenna 30 according to a second embodiment of the invention comprises a base body 31, a feeding terminal 32, a ground terminal 33, and a radiating electrode 34 the base body 31 is made of a substantially rectangular parallelepiped dielectric or magnetic material. The feeding terminal 32 is formed at one end side part 31*a* of one side surface a of the base body 31. The ground terminal 33 is formed at the other end side part 31*b* of one side surface a of the base body 31. The radiating electrode 34 is formed of a line-shaped conductor. The radiating electrode 34, to one end 34*a* of which is connected the ground terminal 33, is disposed such that its other end 34*b* extends from the other end side part 31*b* of one side surface a of the base body 31, through the other end side parts 31*d*, 31*f* of one principal surface b and another side surface c of the base body 31, to the one end side part 31*e* of the other side surface c, then turns to one end side part 31*c* of one principal surface b so as to extend farther toward the other end side part 31*d* of one principal surface b, and is eventually formed into an open end facing substantially perpendicularly with a midpoint of the other end side part 31*d* of one principal surface b. In addition, in the radiating electrode 34, a turned portion 35 is formed on the one end side part 31*c* of one principal surface b. The feeding terminal 32 is so disposed as to extend from the one end side part 31*a* of one side surface a to the one end side part 31*c* of one principal surface b, and has its open end 32*a* arranged in proximity to the radiating electrode 34.

Moreover, a mounting substrate 36 comprises a substrate 37, a feeding electrode 38 formed on the top surface of the substrate 37, a ground electrode 39, and a ground conductor layer 40 having connection with the ground electrode 39. The ground conductor layer 40 is arranged face to face with one side of the ground electrode 39, that is, in the example shown in FIG. 2A, arranged on the left-hand front side of the top surface of the substrate.

Then, the surface-mount type antenna 30 according to the second embodiment of the invention is mounted on the mounting substrate 36, with the other principal surface (corresponding to the bottom surface, in the embodiment shown in FIG. 2A) of the base body 31 arranged on the top, surface of the mounting substrate 36 face to face with the other side of the ground electrode 39 (arranged on the right-hand rear side of the top surface of the substrate, in the embodiment shown in FIG. 2A). Simultaneously, the feeding terminal 32 and the ground terminal 33 are connected to the feeding electrode 38 and the ground electrode 39, respectively. Thereupon, an antenna apparatus 41 of the invention is realized.

A remarkable feature of the surface-mount type antenna 30 according to the second embodiment of the invention is the configurations of the radiating electrode 34 and the feeding terminal 32. Specifically, the radiating electrode 34 is formed that its other end extends from the one end side part 31*c* of one principal surface b of the base body 31 to the other end side part 31*d* thereof, thereby creating the turned portion 35, and is eventually formed into an open end 34*b* near the other end side part 31*d*. The length of the radiating electrode 34 between the turned portion 35 and the open end 34*b* is kept in a range of ⅕ to ¾ of the length of the base body 31. Meanwhile, the feeding terminal 32 has its open end 32*a* opposed to the radiating electrode 34 near the turned portion 35.

In the antenna apparatus 41 of the invention, the surface-mount type antenna 30 according to the second embodiment of the invention is similar in structure to the surface-mount type antenna 10 according to the first embodiment of the invention shown in FIGS. 1A to 1D, but the difference is that the radiating electrode 34 is so formed as to extend across the other side surface c. Just as is the case with the antenna apparatus 21 of the invention, the surface-mount type antenna 30 according to the second embodiment of the invention is mounted on the top surface of the mounting substrate 36 at a distance of approximately 0.5 mm to 3 mm, for example, from the end of the ground conductor layer 40. Simultaneously, the ground terminal 33 is connected via the ground electrode 39 to the ground conductor layer 40. Thereupon, the antenna apparatus 41 is operable at a frequency band of approximately 1 GHz to 10 GHz, for example.

In this way, by configuring the radiating electrode 34 so as to extend across the other side surface c, the radiating electrode 34 can be made longer, and correspondingly the operating frequency is decreased. This does away with the need for making the base body 31 larger in outer dimension, thus achieving compactness in the antenna.

Figure 3A:
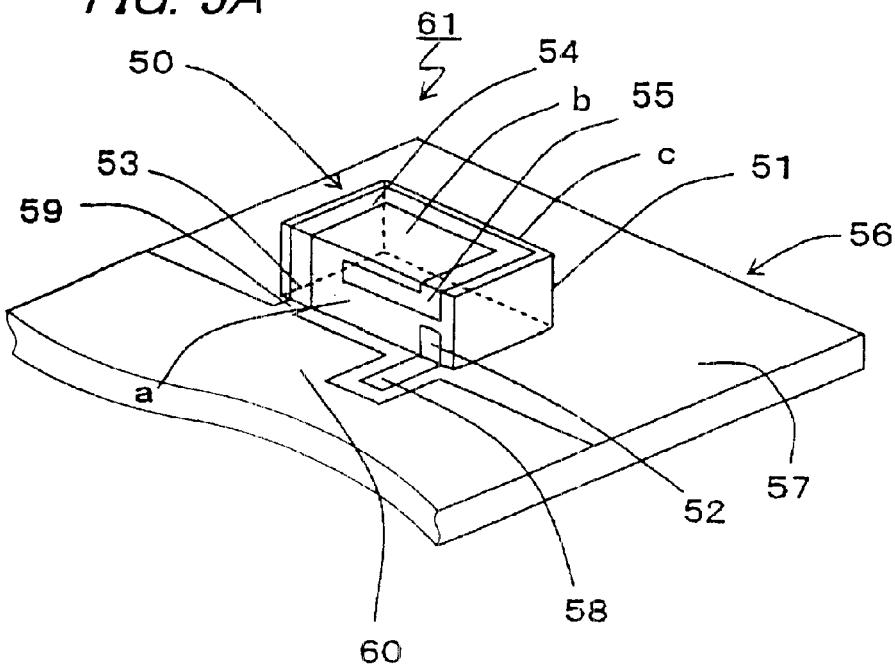
FIG. 3A is a perspective view showing a surface-mount type antenna according to a third embodiment of the invention, and also an antenna apparatus that is constituted by mounting the surface-mount type antenna on the top surface of a mounting substrate according to a third embodiment of the invention.
Figure 3B:
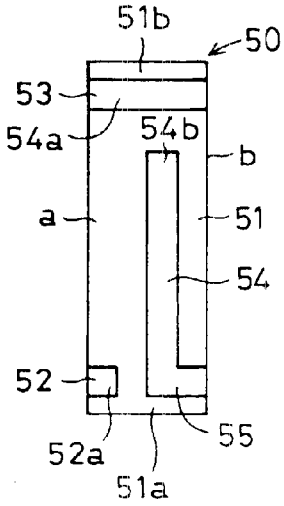
FIG. 3B is a view showing the surface-mount type antenna according to the third embodiment of the invention, viewed from one side surface side.
Figure 3C:
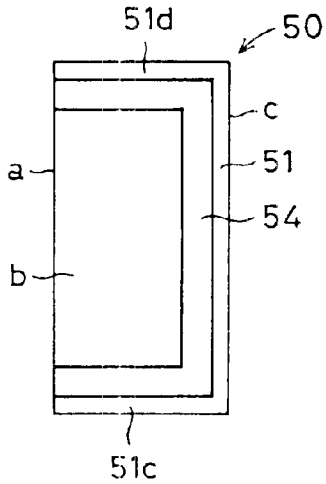
FIG. 3C is a view showing the surface-mount type antenna according to the third embodiment of the invention, viewed from one principal surface side.
Figure 3D:
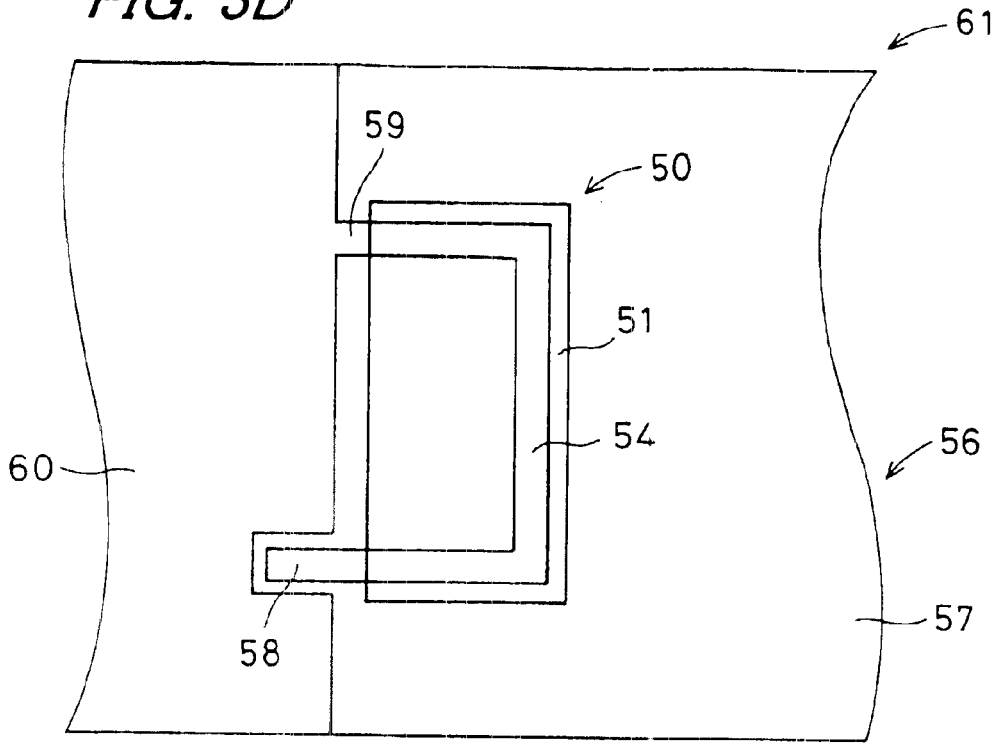
FIG. 3D is a plan view showing the surface-mount type antenna according to the third embodiment of the invention, and also the antenna apparatus that is constituted by mounting the surface-mount type antenna on the top surface of the mounting substrate according to the third embodiment of the invention.

FIG. 3A is a perspective view showing a surface-mount type antenna according to a third embodiment of the invention, and also an antenna apparatus that is constituted by mounting the surface-mount type antenna on the top surface of a mounting substrate according to a third embodiment of the invention; FIG. 3B is a view showing the surface-mount type antenna according to the third embodiment of the invention, viewed from one side surface side; FIG. 3C is a view showing the surface-mount type antenna according to the third embodiment of the invention, viewed from one principal surface side; and FIG. 3D is a plan view showing the surface-mount type antenna according to the third embodiment of the invention, and also the antenna apparatus that is constituted by mounting the surface-mount type antenna on the top surface of the mounting substrate according to the third embodiment of the invention.

In FIGS. 3A to 3D, a surface-mount type antenna 50 according to a third embodiment of the invention comprises a base body 51, a feeding terminal 52, a ground terminal 53, and a radiating electrode 54. The base body 51 is made of a substantially rectangular parallelepiped dielectric or magnetic material. The feeding terminal is formed at one end side part 51*a* of one side surface a of the base body 51. The ground terminal is formed at another end side part 51*b* of one side surface a of the base body 51. The radiating electrode 54 is formed of a line-shaped conductor. The radiating electrode 34, to one end 54*a* of which is connected the ground terminal, is disposed such that its other end 54*b* extends from the other end side part 5*b* of one side surface a, through the other end side part 51*d* of one principal surface b of the base body 51, to the one end side part 51*c* of one principal surface b, then extends to the one end side part 51*a* of one side surface a so as to extend farther toward the other end side part 51*b* of one side surface a, and is eventually formed into an open end facing substantially perpendicularly with a midpoint of the other end side part 51*b* of one side surface a. In addition, in the radiating electrode 54, a turned portion 55 is formed on the one end side part 51*a* of one side surface a. The feeding terminal 52 has its open end 52*a* arranged in proximity to the radiating electrode 54 in the one end side part 51*a* of one side surface a.

Moreover, a mounting substrate 56 comprises a substrate 57, a feeding electrode 58 formed on the top surface of the substrate 57, a ground electrode 59, and a ground conductor layer 60 having connection with the ground electrode 59. The ground conductor layer 60 is arranged face to face with one side of the ground electrode 59, that is, in the example shown in FIG. 3A, arranged on the left-hand front side of the top surface of the substrate.

Then, the surface-mount type antenna 50 according to the third embodiment of the invention is mounted on the mounting substrate 56, with the other principal surface (corresponding to the bottom surface, in the embodiment shown in FIG. 3A) of the base body 51 arranged on the top surface of the mounting substrate 56 face to face with the other side of the ground electrode 59 (arranged on the right-hand rear side of the top surface of the substrate, in the embodiment shown in FIG. 3A). Simultaneously, the feeding terminal 52 and the ground terminal 53 are connected to the feeding electrode 58 and the ground electrode 59, respectively. Thereupon, an antenna apparatus 61 of the invention is realized.

A remarkable feature of the surface-mount type antenna 50 according to the third embodiment of the invention is the configurations of the radiating electrode 54 and the feeding terminal 52. Specifically, the radiating electrode 54 is formed such that its other end extends from one end side part 51*a* of one side surface a of the base body 51 to the other end side part 51*b* thereof, thereby creating the turned portion 55, and is eventually formed into an open end. The length of the radiating electrode 54 between the turned portion 55 and the open end is kept in a range of ⅕ to ¾ of the length of the base body 51. Meanwhile, the feeding terminal 52 has its open end 52*b* opposed to the radiating electrode 54 near the turned portion 55.

In the antenna apparatus 61 of the invention, the surface-mount type antenna 50 according to the third embodiment of the invention is similar in structure to the surface-mount type antenna 10 according to the first embodiment of the invention shown in FIGS. 1A to 1D, but the difference is that both the turned portion 55 and the open end 54*b* are formed on one side surface a. Just as is the case with the antenna apparatus 21 of the invention, the surface-mount type antenna 50 according to the third embodiment of the invention is mounted on the top surface of the mounting substrate 56 at a distance of approximately 0.5 mm to 3 mm, for example, from the end of the ground conductor layer 60. Simultaneously, the ground terminal 53 is connected via the ground electrode 59 to the ground conductor layer 60. Thereupon, the antenna apparatus 61 is operable at a frequency band of approximately 1 GHz to 10 GHz, for example.

In this way, by forming both the turned portion 55 and the open end 54*b* on one side surface a, the interval between the ground conductor layer 60 and that conductor part of the radiating electrode 54 which extends from the turned portion 55 to the open end 54*b* can be made shorter; wherefore a larger capacitance component can be created and correspondingly the operating frequency is decreased. This does away with the need for making the base body 51 larger in outer dimension, thus achieving compactness in the antenna.

Figure 4A:
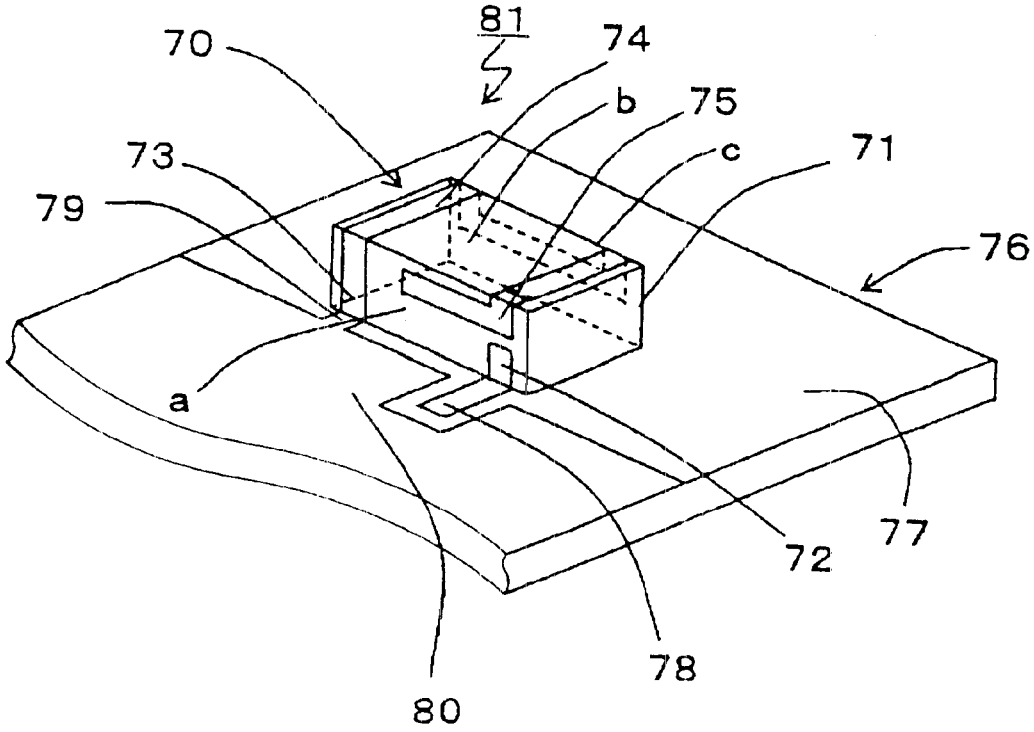
FIG. 4A is a perspective view showing a surface-mount type antenna according to a fourth embodiment of the invention, and also an antenna apparatus that is constituted by mounting the surface-mount type antenna on the top surface of a mounting substrate according to a fourth embodiment of the invention.
Figure 4B:
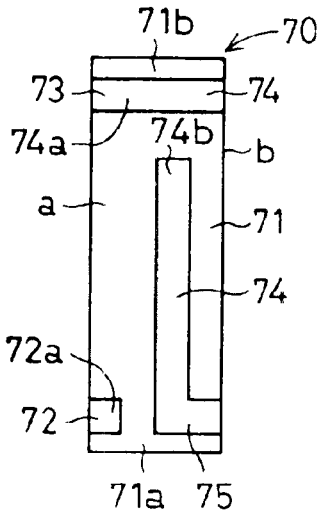
FIG. 4B is a view showing the surface-mount type antenna according to the fourth embodiment of the invention, viewed from one side surface side.
Figure 4C:
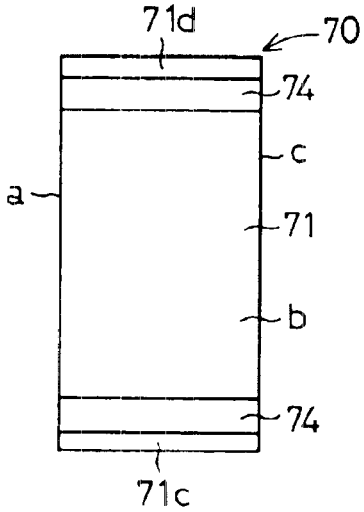
FIG. 4C is a view showing the surface-mount type antenna according to the fourth embodiment of the invention, viewed from one principal surface side.
Figure 4D:
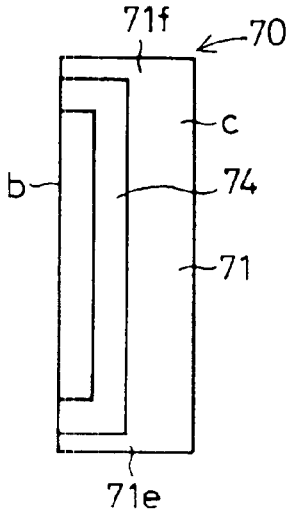
FIG. 4D is a view showing the surface-mount type antenna according to the fourth embodiment of the invention, viewed from another side surface side.
Figure 4E:
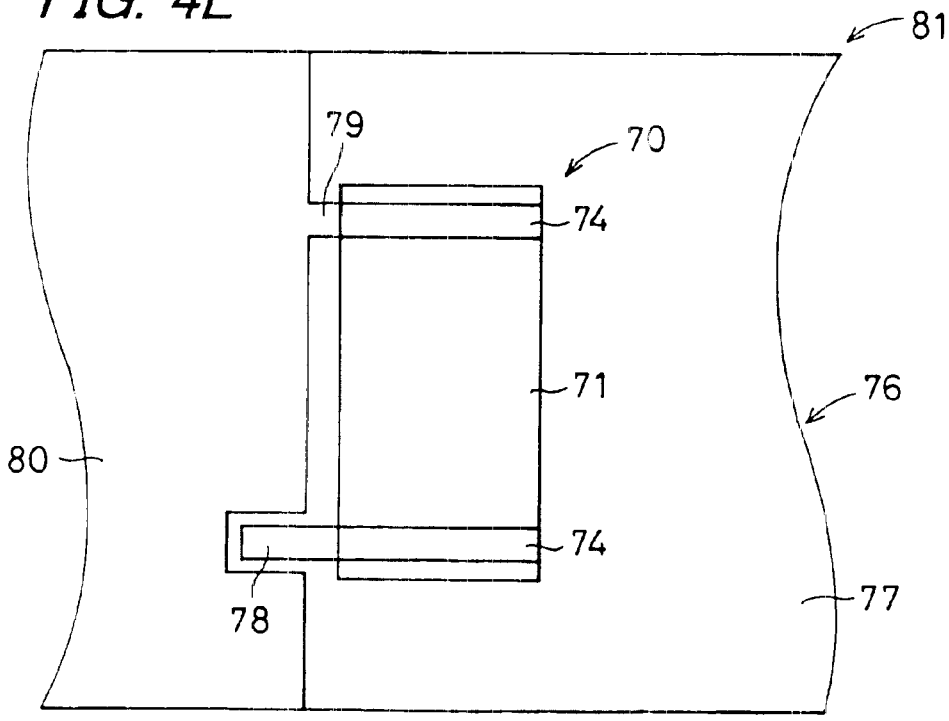
FIG. 4E is a plan view showing the surface-mount type antenna according to the fourth embodiment of the invention, and also the antenna apparatus that is constituted by mounting the surface-mount type antenna on the top surface of the mounting substrate according to the fourth embodiment of the invention.

FIG. 4A is a perspective view showing a surface-mount type antenna according to a fourth embodiment of the invention, and also an antenna apparatus that is constituted by mounting the surface-mount type antenna on the top surface of a mounting substrate according to a fourth embodiment of the invention; FIG. 4B is a view showing the surface-mount type antenna according to the fourth embodiment of the invention, viewed from one side surface side; FIG. 4C is a view showing the surface-mount type antenna according to the fourth embodiment of the invention, viewed from one principal surface side; FIG. 4D is a view showing the surface-mount type antenna according to the fourth embodiment of the invention, viewed from another side surface side; and FIG. 4E is a plan view showing the surface-mount type antenna according to the fourth embodiment of the invention, and also the antenna apparatus that is constituted by mounting the surface-mount type antenna on the top surface of the mounting substrate according to the fourth embodiment of the invention.

In FIGS. 4A to 4E, a surface-mount type antenna 70 according to a fourth embodiment of the invention comprises a base body 71, a feeding terminal 72, a ground terminal 73, and a radiating electrode 74. The base body 71 is made of a substantially rectangular parallelepiped dielectric or magnetic material. The feeding terminal 72 is formed at one end side part 71*a* of one side surface a of the base body 71. The ground terminal 73 is formed at the other end side part 71*b* of one side surface a. The radiating electrode 74 is formed of a line-shaped conductor. The radiating electrode 74, to one end 74*a* of which is connected the ground terminal 73, is disposed such that its other end extends from the other end side part 71*b* of one side surface a of the base body 71, through the other end side parts 71*d*, 71*f* of one principal surface b and the other side surface c of the base body 71, to the one end side part 71*e* of the other side surface c, then extends through the one end side part 71*c* of one principal surface b to the one end side part 71*a* of one side surface a so as to extend farther toward the other end side part 71*b* of one side surface a, and is eventually formed into an open end facing substantially perpendicularly with a midpoint of the other end side part 71*b* of one side surface a. In addition, in the radiating electrode 74, a turned portion 75 is formed on the one end side part 71*a* of one side surface a. The feeding terminal 72 has its open end 72*a* arranged in proximity to the radiating electrode 74 in the one end side part 71*a* of one side surface a.

Moreover, a mounting substrate 76 comprises a substrate 77, a feeding electrode 78 formed on the top surface of the substrate 77, a ground electrode 79, and a ground conductor layer 80 having connection with the ground electrode 79. The ground conductor layer 80 is arranged face to face with one side of the ground electrode 79, that is, in the example shown in FIG. 4A, arranged on the left-hand front side of the top surface of the substrate.

Then, the surface-mount type antenna 70 according to the fourth embodiment of the invention is mounted on the mounting substrate 76, with the other principal surface. (corresponding to the bottom surface, in the embodiment shown in FIG. 4A) of the base body 71 arranged on the top surface of the mounting substrate 76 face to face with the other side of the ground electrode 79 (arranged on the right-hand rear side of the top surface of the substrate, in the embodiment shown in FIG. 4A). Simultaneously, the feeding terminal 72 and the ground terminal 73 are connected to the feeding electrode 78 and the ground electrode 79, respectively. Thereupon, an antenna apparatus 81 of the invention is realized.

A remarkable feature of the surface-mount type antenna 70 according to the fourth embodiment of the invention is the configurations of the radiating electrode 74 and the feeding terminal 72. Specifically, the radiating electrode 74 is formed such that its other end extends from one end side part 71*a* of one side surface a of the base body 71 to the other end side part 71*b* thereof, thereby creating the turned portion 75, and is eventually formed into an open end. The length of the radiating electrode 74 between the turned portion 75 and the open end is kept in a range of ⅕ to ¾ of the length of the base body 71. Meanwhile, the feeding terminal 72 has its open end 72*b* opposed to the radiating electrode 74 near the turned portion 75.

In the antenna apparatus 81 of the invention, the surface-mount type antenna 70 according to the fourth embodiment of the invention is similar in structure to the surface-mount type antenna 10 according to the first embodiment of the invention shown in FIGS. 1A to D, but the difference is that the radiating electrode 74 is so formed as to extend across the other side surface c, and both the turned portion 75 and the open end 74*b* are formed on one side surface a. Just as is the case with the antenna apparatus 21 of the invention, the surface-mount type antenna 70 according to the fourth embodiment of the invention is mounted on the top surface of the mounting substrate 76 at a distance of approximately 0.5 mm to 3 mm, for example, from the end of the ground conductor layer 80. Simultaneously, the ground terminal 73 is connected via the ground electrode 79 to the ground conductor layer 80. Thereupon, the antenna apparatus 81 is operable at a frequency band of approximately 1 GHz to 10 GHz, for example.

In this way, by configuring the radiating electrode 74 so as to extend across the other side surface c, as well as by forming both the turned portion 75 and the open end 74*b* on one side surface a, the interval between the ground conductor layer 80 and that conductor part of the radiating electrode 74 which extends from the turned portion 75 to the open end 74*b* can be made shorter; wherefore a larger capacitance component can be created. Moreover, the radiating electrode 74 can be made longer, and correspondingly the operating frequency is decreased. This does away with the need for making the base body 71 larger in outer dimension, thus achieving compactness in the antenna.

With reference to the schematic equivalent circuit diagram shown in FIG. 5, a description will be given below as to the function of the antenna structure in the surface-mount type antenna 10, 30, 50, 70 according to the first to fourth embodiments of the invention and the antenna apparatus 21, 41, 61, 81 employing the same.

Figure 5:
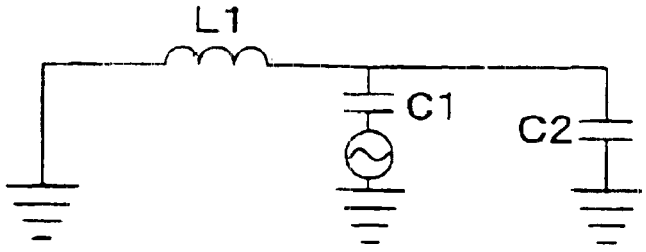
FIG. 5 is a schematic equivalent circuit diagram for explaining the function of the antenna structure in the surface-mount type antenna and the antenna apparatus embodying the invention.

In FIG. 5, reference symbol L1 denotes an inductance of the radiating electrode 14, 34, 54, 74 extending from the ground conductor layer 20, 40, 60, 80, through the ground electrode 19, 39, 59, 79 and the ground terminal 13, 33, 53, 73, to the surfaces of the base body 11, 31, 51, 71; C2 denotes a capacitance generated between the ground conductor layer 20, 40, 60, 80 and that part of the radiating electrode 14, 34, 54, 74 which extends from the turned portion 15, 35, 55, 75 to the open end 14*b*, 34*b*, 54*b* and 74*b*; and C1 denotes a capacitance generated mainly between the turned portion 15, 35, 55, 75 of the radiating electrode 14, 34, 54, 74 and the feeding terminal 12, 32, 52, 72. Note that between the capacitance C1 and the ground is connected a high-frequency signal power supply, and that the equivalent circuit further includes radiation resistance (not shown) of the radiating electrode 14, 34, 54, 74. The radiating electrode 14, 34, 54, 74, which extends from the ground conductor layer 20, 40, 60, 80, through the ground electrode 19, 39, 59, 79 and the ground terminal 13, 33, 53, 73, to the surfaces of the base body 11, 31, 51, 71, has the turned portion 15, 35, 55, 75. Here, a capacitance generated between the turned portion 15, 35, 55, 75 and the ground conductor layer 20, 40, 60, 80 can be ignored, because the current flowing nearby is so large that the inductance component becomes predominant. Further, the inductance as observed in that part of the radiating electrode 14, 34, 54, 74 which extends from the turned portion 15, 35, 55, 75 to the open end can also be ignored, because the current flowing toward the open end 14*b*, 34*b*, 54*b* and 74*b* is so small that the capacitance component becomes predominant.

The operating frequency of the surface-mount type antenna 10, 30, 50, 70 of the invention can be controlled by adjusting the inductance L1 of the radiating electrode 14, 34, 54, 74 and the capacitance C2. Moreover, by adding the capacitance C2, the resonant frequency of the antenna can be decreased. This makes it possible to achieve miniaturization of the antenna without increasing the dielectric constant of the base body, and without excessively slenderizing the radiating electrode.

Here, the capacitance C2 generated between the ground conductor layer 20, 40, 60, 80 and that part of the radiating electrode which extends from the turned portion 15, 35, 55, 75 to the open end 14*b*, 34*b*, 54*b* and 74*b* is roughly proportional to the length of the radiating electrode between the turned portion and the open end. Hence, making adjustment to the length of the radiating electrode between the turned portion and the open end helps facilitate frequency adjustment to the antenna.

It is preferable that the length of the radiating electrode between the turned portion 15, 35, 55, 75 and the open end 14*b*, 34*b*, 54*b* and 74*b* is kept in a range of ⅕ to ¾ of the length of the base body 11, 31, 51, 71. In this case, at the time of making frequency adjustment on the basis of the length of the radiating electrode between the open end 14*b*, 34*b*, 54*b* and 74*b* and the turned portion 15, 35, 55, 75, the relationship between the length of the radiating electrode between the open end 14*b*, 34*b*, 54*b* and 14*b* and the turned portion 15, 35, 55, 75 and the resonant frequency of the antenna assumes linearity. Hence, it is possible to realize an antenna that offers satisfactory frequency adjustability. If the length of the radiating electrode between the turned portion 15, 35, 55, 75 and the open end 14*b*, 34*b*, 54*b* and 74*b* is less than ⅕ of the length of the base body, the length of the radiating electrode between the open end 14*b*, 34*b*, 54*b* and 74*b* to the turned portion 15, 35, 55, 75 is so short that the resonant frequency is undesirably limited in its range of adjustment. By contrast, if the length of the radiating electrode between the turned portion 15, 35, 55, 75 to the open end 14*b*, 34*b*, 54*b* and 74*b* is greater than ¾ of the length of the base body, a needless capacitance component is undesirably created between the open end 14*b*, 34*b*, 54*b* and 74*b* and a midpoint of the other end side part of the radiating electrode 14, 34, 54, 74.

Meanwhile, the capacitance C1 can be set at an appropriate value by adjusting the interval of the gap between the turned portion 15, 35, 55, 75 and the feeding terminal 12, 32, 52, 72.

In the surface-mount type antenna 10, 30, 50, and 70 according to the first to fourth embodiments of the invention, the capacitance C1 existing between the turned portion 15, 35, 55, 75 of the radiating electrode 14, 34, 54, 74 and the feeding terminal 12, 32, 52, 72 is created to achieve impedance adjustment so that the radiating electrode 14, 34, 54, 74 can be excited efficiently. To achieve impedance adjustment so that the radiating electrode 14, 34, 54, 74 can be excited efficiently, the capacitance C1 should preferably be changed by varying the interval between the turned portion 15, 35, 55, 75 and the feeding terminal 12., 32, 0.52, 72.

At this time, since the capacitance C1 and the impedance of the feeding line are higher relative to the capacitance C2, the resonant frequency of the antenna is dependent mainly on the values for the capacitance C2 and the inductance L1. Thus, it never occurs that the resonant frequency of the antenna is varied greatly with the change of the capacitance C1. As a result, according to the surface-mount type antenna 10, 30, 50, and 70 and the antenna apparatus 21, 41, 61, and 81 according to the first to fourth embodiments of the invention, not only it is possible to achieve miniaturization, but it is also possible to attain the desired antenna characteristics as designed.

In the surface-mount type antenna 10, 30, 50, and 70 according to the first to fourth embodiments of the invention, the base body 11, 31, 51, 71 is made of a substantially rectangular parallelepiped dielectric or magnetic material. For example, there is prepared a dielectric material which is predominantly composed of alumina (relative dielectric constant: 9.6). The dielectric material in powder form is subjected to pressure-molding and firing to obtain ceramics. Using the ceramics, the base body is fabricated. In the alternative, the base body 11, 31, 51, 71, may be composed of a composite material made of ceramics, i.e. a dielectric material, and resin, or composed of a magnetic material such as ferrite.

In a case where the base body 11, 31, 51, 71 is composed of a dielectric material, a high frequency signal propagates through the radiating electrode 14, 34, 54, 74 at a lower speed, resulting in the wavelength becoming shorter. When the relative dielectric constant of the base body 11, 31, 51, 71 is expressed as $\in r$, the effective length of the conductor pattern of the radiating electrode 14, 34, 54, 74 is reduced to a value: $(1/\in r)^{1/2}$. Hence, where the pattern length is kept the same, as the relative dielectric constant of the base body 11, 31, 51, 71 is increased, the current distribution region becomes larger and larger in area. This allows the radiating electrode 14, 34, 54, 74 to emit a larger quantity of radio waves, resulting in an advantage in enhancing the gain of the antenna.

Meanwhile, in the case of attaining the same antenna characteristics as conventional ones, the pattern length of the radiating electrode 14, 34, 54, 74 can be given as $(1/\in r)^{1/2}$, thus making the surface-mount type antenna 10, 30, 50, and 70 according to the first to fourth embodiments of the invention compact.

Note that fabricating the base body 11, 31, 51, 71 using a dielectric material poses the following tendencies. If the value $\in r$ is less than 3, it approaches the relative dielectric constant as observed in the air ($\in r=1$). This makes it difficult to meet the demand of the market for antenna miniaturization. By contrast, if the value $\in r$ exceeds 30, although miniaturization can be achieved, since the gain and the bandwidth of the antenna are proportional to the size of the antenna, the gain and the bandwidth of the antenna are sharply decreased. As a result, the antenna fails to offer satisfactory antenna characteristics. Hence, in the case of fabricating the base body 11, 31, 51, 71 using a dielectric material, it is preferable to use a dielectric material having a relative dielectric constant $\in r$ which is kept within a range from 3 to 30. The preferred examples of such a dielectric material include ceramic materials typified by alumina ceramics, zirconia ceramics, etc; and resin materials typified by tetrafluoroethylene, glass epoxy, etc.

On the other hand, in the case of fabricating the base body 11, 31, 51, 71 using a magnetic material, the radiating electrode 14, 34, 54, 74 has a higher impedance. Thus, the Q factor of the antenna becomes lower, and correspondingly the bandwidth can be increased.

Fabricating the base body 11, 31, 51, 71 using a magnetic material poses the following tendency. If the relative magnetic permeability $\mu r$ exceeds 8, although a wider bandwidth can be achieved in the antenna, since the gain and the bandwidth of the antenna are proportional to the size of the antenna, the gain and the bandwidth of the antenna are sharply decreased. As a result, the antenna fails to offer satisfactory antenna characteristics. Hence, in the case of fabricating the base body 11, 31, 51, 71 using a magnetic material, it is preferable to use a magnetic material having a relative magnetic permeability $\mu r$ which is kept within a range from 1 to 8. The preferred examples of such a magnetic material include YIG (Yttria Iron Garnet), Ni—Zr compound, and Ni—Co—Fe compound.

In the surface-mount type antenna 10, 30, 50, and 70 according to the first to fourth embodiments of the invention, it is preferable that the base body 11, 31, 51, 71 has a through hole drilled all the way through from one end face to the other end face, or a groove formed on the other principal surface of the base body 11, 31, 51, 71 so as to penetrate all the way through from one end face to the other end face. In this case, the effective relative dielectric constant of the base body 11, 31, 51, 71 can be decreased; wherefore the accumulation of electrolytic energy can be suppressed. This makes it possible to achieve a wider bandwidth in the surface-mount type antenna 10, 30, 50, and 70 according to the first to fourth embodiments of the invention.

Figure 6A:
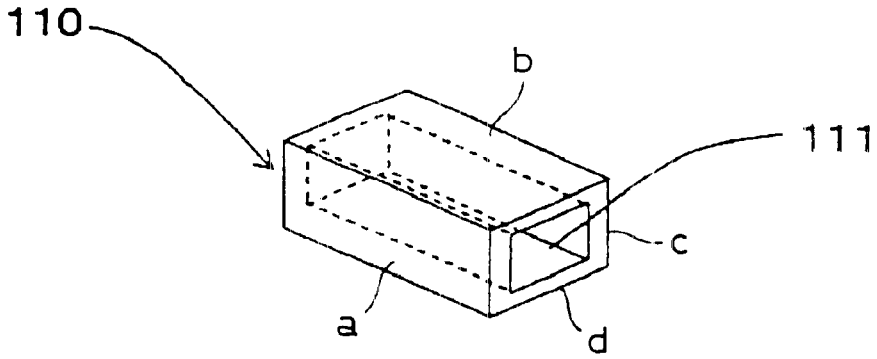
FIGS. 6A and 6B are perspective views each showing an example of the base-body configuration in the surface-mount type antenna of the invention, with FIG. 6A indicating the case of forming a through hole, and FIG. 6B indicating the case of forming a groove.
Figure 6B:
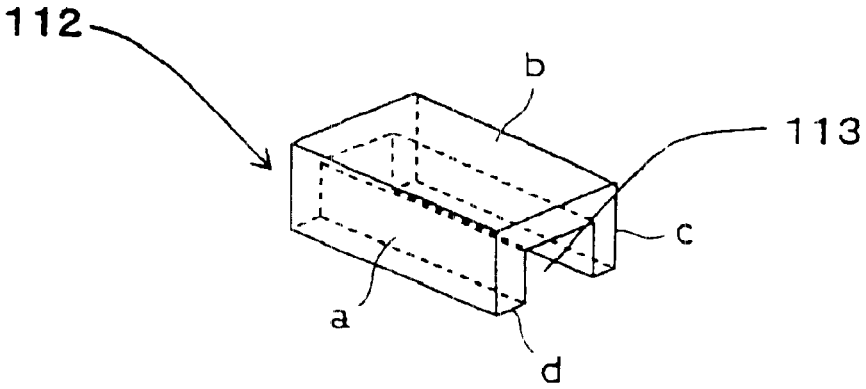
Figure 7:
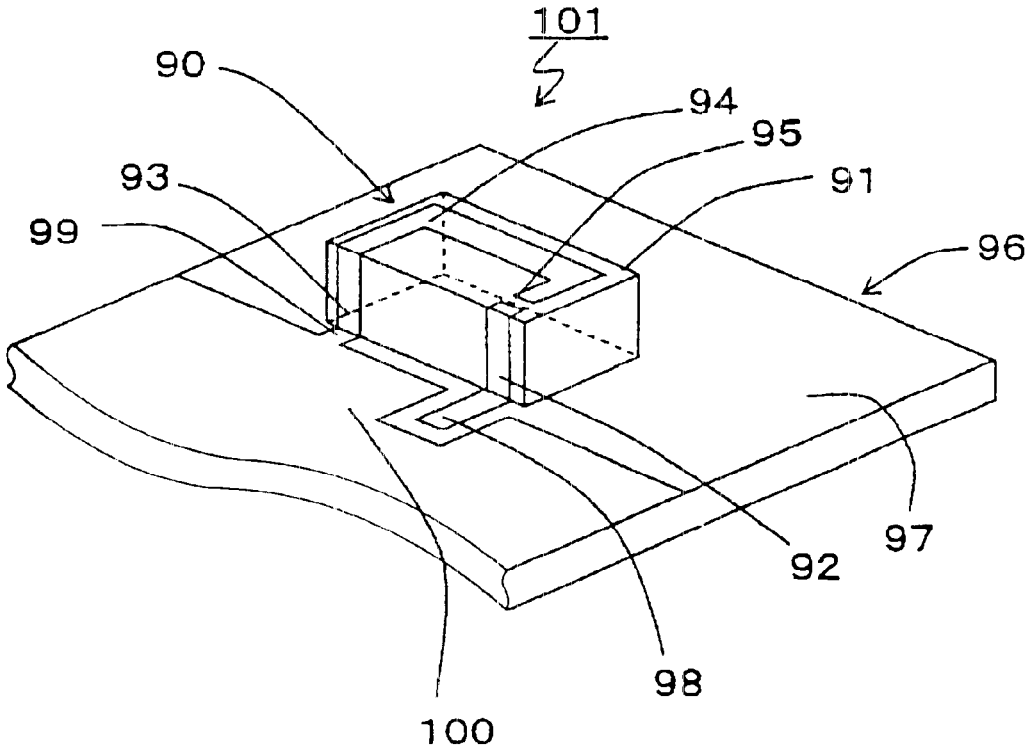
FIG. 7 PRIOR ART
FIG. 7 is a perspective view showing an example of a conventional surface-mount type antenna and an antenna apparatus incorporating the antenna.

FIGS. 6A and 6B are perspective views each showing an example of the base-body configuration. In FIG. 6A, the base body 110, a through hole 111 is formed so as to penetrate all the way through from one end face to the other end face in a longitudinal direction of the base body 110. In FIG. 6B, in the base body 112, a groove 113 is formed on the other principal surface d of the base body 112 so as to penetrate all the way through from one end face to the other end face in a longitudinal direction of the base body 112.

The radiating electrode 14, 34, 54, 74, the turned portion 15, 35, 55, 75, the feeding terminal 12, 32, 52, 72 and the ground terminal 13, 33, 53, 73 are each made of for example a metal material which is predominantly composed of one selected from the group consisting of aluminum, copper, nickel, silver, palladium, platinum, and gold. In order to form various patterns using the aforementioned metal materials, conductor layers having desired pattern configurations are formed on the surface of the base body 11, 31, 51, 71 by means of a conventionally-known printing method, a thin-film forming technique based on a vapor-deposition method, a sputtering method, etc., a metal foil bonding method, plating method, or the like.

As the substrate 17, 37, 57, 77 constituting the mounting substrate 16, 36, 56, 76, an ordinary circuit substrate made of for example glass epoxy or alumina ceramics is employed.

Moreover, the feeding electrode 18, 38, 58, 78 and the ground electrode 19, 39, 59, 79 are each composed of a conductor which is employed in an ordinary circuit substrate, such as copper or silver.

The ground conductor layer 20, 40, 60, 80, which is arranged on the top surface of the mounting substrate 16, 36, 56, 76 face to face with one side of the ground electrode 19, 39, 59, 79, is preferably composed of a conductor material such as copper or silver which is commonly employed in an ordinary circuit board. Moreover, the antenna is preferably mounted so as to protrude from the edge of the ground conductor layer 20, 40, 60, 80. This is desirable in terms of enhancement of the bandwidth and gain of the antenna.

Note that mounting of the surface-mount type antenna 10, 30, 50, 70 on the top surface of the mounting substrate 16, 36, 56, 76, as well as connecting the feeding terminal 12, 32, 52, 72 and the ground terminal 13, 33, 53, 73 to the feeding electrode 18, 38, 58, 78 and the ground electrode 19, 39, 59, 79, respectively, is preferably achieved by means of soldering through a reflow furnace, for example.

(Working Example)

Next, a description will be given as to a practical example of the surface-mount type antenna and the antenna apparatus according to the first embodiment of the invention. The example is built as a 1.575 GHz-band antenna designed for GPS.

In an ordinary quarter-wavelength monopole antenna, the length of its antenna element is set at 47 mm. Meanwhile, the surface-mount type antenna 10 according to the fist embodiment of the invention shown in FIGS. 1A to 1D is constructed as follows. Firstly, there is prepared an alumina-made base body (dimension: 10 mm×4 mm×3 mm). Then, like the radiating electrode 14 shown in FIGS. 1A to 1D, a 1 mm-wide conductor pattern is formed thereon using a silver conductor. Next, the turned portion 15 is created. The length of the radiating electrode 14 between the turned portion 15 and the open end 14*b* is set at 3 mm. Thereby, the resonant frequency of the surface-mount type antenna 10 according to the first embodiment is adjusted properly.

As the mounting substrate 16, a 0.8 mm-thick glass epoxy substrate is used. The ground conductor layer 20 has the size of 40 mm×80 mm. The antenna apparatus 21 according to the first embodiment of the invention is characterized by the center frequency of 1.575 GHz and the bandwidth of 35 MHz.

It is to be understood that the application of the invention is not limited to the specific embodiments described heretofore, and that many modifications and variations of the invention are possible within the spirit and scope of the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A surface-mount type antenna comprising:

a base body made of a substantially rectangular parallelepiped dielectric or magnetic material;

a feeding terminal formed at one end side part of one side surface of the base body;

a ground terminal formed at another end side part of one side surface of the base body; and a radiating electrode, to one end of which is connected the ground terminal, disposed such that its other end extends from the other end side part of one side surface, through the other end side part of one principal surface of the base body, to the one end side part of one principal surface, then turns to one side surface so as to extend farther toward the other end side part of one principal surface, and is eventually formed into an open end facing substantially perpendicularly with a midpoint of the other end side part of one principal surface, wherein the feeding terminal is so disposed as to extend from the one end side part of one side surface to the one end side part of one principal surface, and has its open end arranged in proximity to the radiating electrode.

2. The surface-mount type antenna of claim 1, wherein the length of the radiating electrode between the open end and a turned portion on the one end side part of one principal surface is kept in a range of ⅕ to ¾ of the length of one principal surface of the base body.

3. The surface-mount type antenna of claim 1, wherein the base body has a through hole which penetrates all the way through from one end face to the other end face thereof, or a groove formed on another principal surface thereof so as to penetrate all the way through from one end face to the other end face.

4. The surface-mount type antenna of claim 1, wherein the base body is made of a dielectric material having a relative dielectric constant $\in r$ which is kept within a range from 3 to 30.

5. The surface-mount type antenna of claim 1, wherein the base body is made of a magnetic material having a relative magnetic permeability $\mu r$ which is kept within a range from 1 to 8.

6. An antenna apparatus comprising:

a mounting substrate having formed thereon a feeding electrode, a ground electrode, and a ground conductor layer which is arranged face to face with one side of the ground electrode and has connection with the ground electrode; and the surface-mount type antenna of claim 1, wherein the antenna apparatus is constructed by mounting the surface-mount type antenna on the mounting substrate, with another principal surface of the base body arranged on the top surface of the mounting substrate face to face with the other side of the ground electrode, and simultaneously connecting the feeding terminal and the ground terminal to the feeding electrode and the ground electrode, respectively.

7. A surface-mount type antenna comprising:

a base body made of a substantially rectangular parallelepiped dielectric or magnetic material;

a feeding terminal formed at one end side part of one side surface of the base body;

a ground terminal formed at another end side part of one side surface of the base body; and a radiating electrode, to one end of which is connected the ground terminal, disposed such that its other end extends from the other end side part of one side surface, through the other end side parts of one principal surface and another side surface of the base body, to the one end side part of the other side surface, then turns to one end side part of one principal surface so as to extend farther toward the other end side part of one principal surface, and is eventually formed into an open end facing substantially perpendicularly with a midpoint of the other end side part of one principal surface, wherein the feeding terminal is so disposed as to extend from the one end side part of one side surface to the one end side part of one principal surface, and has its open end arranged in proximity to the radiating electrode.

8. The surface-mount type antenna of claim 7, wherein the length of the radiating electrode between the open end and a turned portion on the one end side part of one principal surface is kept in a range of ⅕ to ¾ of the length of one principal surface of the base body.

9. The surface-mount type antenna of claim 7, wherein the base body has a through hole which penetrates all the way through from one end face to the other end face thereof, or a groove formed on another principal surface thereof so as to penetrate all the way through from one end face to the other end face.

10. The surface-mount type antenna of claim 7, wherein the base body is made of a dielectric material having a relative dielectric constant $\in r$ which is kept within a range from 3 to 30.

11. The surface-mount type antenna of claim 7, wherein the base body is made of a magnetic material having a relative magnetic permeability $\mu r$ which is kept within a range from 1 to 8.

12. An antenna apparatus comprising:

a mounting substrate having formed thereon a feeding electrode, a ground electrode, and a ground conductor layer which is arranged face to face with one side of the ground electrode and has connection with the ground electrode; and the surface-mount type antenna of claim 7, wherein the antenna apparatus is constructed by mounting the surface-mount type antenna on the mounting substrate, with another principal surface of the base body arranged on the top surface of the mounting substrate face to face with the other side of the ground electrode, and simultaneously connecting the feeding terminal and the ground terminal to the feeding electrode and the ground electrode, respectively.

13. A surface-mount type antenna comprising:

a base body made of a substantially rectangular parallelepiped dielectric or magnetic material;

a feeding terminal formed at one end side part of one side surface of the base body;

a ground terminal formed at another end side part of one side surface of the base body; and a radiating electrode, to one end of which is connected the ground terminal, disposed such that its other end extends from the other end side part of one side surface, through the other end side part of one principal surface of the base body, to the one end side part of one principal surface, then extends to the one end side part of one side surface so as to extend farther toward the other end side part of one side surface, and is eventually formed into an open end facing substantially perpendicularly with a midpoint of the other end side part of one side surface, wherein the feeding terminal has its open end arranged in proximity to the radiating electrode in the one end side part of one side surface.

14. The surface-mount type antenna of claim 13, wherein the length of the radiating electrode between the open end and a turned portion on the one end side part of one side surface is kept in a range of ⅕ to ¾ of the length of one side surface of the base body.

15. The surface-mount type antenna of claim 13, wherein the base body has a through hole which penetrates all the way through from one end face to the other end face thereof, or a groove formed on another principal surface thereof so as to penetrate all the way through from one end face to the other end face.

16. The surface-mount type antenna of claim 13, wherein the base body is made of a dielectric material having a relative dielectric constant $\in r$ which is kept within a range from 3 to 30.

17. The surface-mount type antenna of claim 13, wherein the base body is made of a magnetic material having a relative magnetic permeability $\mu r$ which is kept within a range from 1 to 8.

18. An antenna apparatus comprising:

a mounting substrate having formed thereon a feeding electrode, a ground electrode, and a ground conductor layer which is arranged face to face with one side of the ground electrode and has connection with the ground electrode; and the surface-mount type antenna of claim 13, wherein the antenna apparatus is constructed by mounting the surface-mount type antenna on the mounting substrate, with another principal surface of the base body arranged on the top surface of the mounting substrate face to face with the other side of the ground electrode, and simultaneously connecting the feeding terminal and the ground terminal to the feeding electrode and the ground electrode, respectively.

19. A surface-mount type antenna comprising:

a base body made of a substantially rectangular parallelepiped dielectric or magnetic material;

a feeding terminal formed at one end side part of one side surface of the base body;

a ground terminal formed at another end side part of one side surface of the base body; and a radiating electrode, to one end of which is connected the ground terminal, disposed such that its other end extends from the other end side part of one side surface, through the other end side parts of one principal surface and another side surface of the base body, to the one end side part of the other side surface, then extends through the one end side part of one principal surface to the one end side part of one side surface so as to extend farther toward the other end side part of one side surface, and is eventually formed into an open end facing substantially perpendicularly with a midpoint of the other end side part of one side surface, wherein the feeding terminal has its open end arranged in proximity to the radiating electrode in the one end side part of one side surface.

20. The surface-mount type antenna of claim 19, wherein the length of the radiating electrode between the open end and a turned portion on the one end side part of one side surface is kept in a range of ⅕ to ¾ of the length of one side surface of the base body.

21. The surface-mount type antenna of claim 19, wherein the base body has a through hole which penetrates all the way through from one end face to the other end face thereof, or a groove formed on another principal surface thereof so as to penetrate all the way through from one end face to the other end face.

22. The surface-mount type antenna of claim 19, wherein the base body is made of a dielectric material having a relative dielectric constant $\in r$ which is kept within a range from 3 to 30.

23. The surface-mount type antenna of claim 19, wherein the base body is made of a magnetic material having a relative magnetic permeability $\mu r$ which is kept within a range from 1 to 8.

24. An antenna apparatus comprising:

a mounting substrate having formed thereon a feeding electrode, a ground electrode, and a ground conductor layer which is arranged face to face with one side of the ground electrode and has connection with the ground electrode; and the surface-mount type antenna of claim 19, wherein the antenna apparatus is constructed by mounting the surface-mount type antenna on the mounting substrate, with another principal surface of the base body arranged on the top surface of the mounting substrate face to face with the other side of the ground electrode, and simultaneously connecting the feeding terminal and the ground terminal to the feeding electrode and the ground electrode, respectively.

* * * * *